US011408159B2

(12) United States Patent
Wu et al.

(10) Patent No.: US 11,408,159 B2
(45) Date of Patent: Aug. 9, 2022

(54) MULTIFUNCTIONAL WATER OUTFLOW DEVICE AND WATER FLOW DIVIDER

(71) Applicant: Xiamen Solex High-Tech Industries Co., Ltd., Xiamen (CN)

(72) Inventors: Shilong Wu, Xiamen (CN); Guosong Zhao, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 300 days.

(21) Appl. No.: 16/727,903

(22) Filed: Dec. 26, 2019

(65) Prior Publication Data

US 2020/0131747 A1 Apr. 30, 2020

Related U.S. Application Data

(63) Continuation of application No. PCT/CN2018/089592, filed on Jun. 1, 2018.

(30) Foreign Application Priority Data

Jun. 26, 2017 (CN) ..... 201710494497.0
Jun. 26, 2017 (CN) ..... 201720750840.9

(51) Int. Cl.
*E03C 1/084* (2006.01)
*B05B 1/16* (2006.01)
*E03C 1/086* (2006.01)

(52) U.S. Cl.
CPC ..... *E03C 1/084* (2013.01); *B05B 1/16* (2013.01); *E03C 1/086* (2013.01)

(58) Field of Classification Search
CPC ..... B05B 1/16; B05B 1/1627; B05B 1/1636; B05B 1/1645; B05B 1/1654; B05B 1/1663; E03C 1/084; E03C 1/086
(Continued)

(56) References Cited

U.S. PATENT DOCUMENTS 4,221,337 A * 9/1980 Shames ..... E03C 1/084 137/625.48
7,380,731 B1 * 6/2008 Hsu ..... B05B 1/1618 239/443
(Continued)

FOREIGN PATENT DOCUMENTS

CN 105363578 A 3/2016
CN 105839712 A 8/2016
(Continued)

OTHER PUBLICATIONS

International Search Report and Written Opinion with English Translation of ISR, cited in PCT/CN2018/089592 dated Aug. 24, 2018, 10 pages.

*Primary Examiner* — Jason J Boeckmann
(74) *Attorney, Agent, or Firm* — Cooper Legal Group, LLC

(57) ABSTRACT

The present disclosure discloses a multifunctional water outflow device comprising a connecting portion and a water outflow portion. The water outflow portion comprises a lower casing. A water dividing portion and a water flow divider are disposed in the lower casing. The water dividing portion is disposed with two water dividing passages. The water flow divider comprises a central portion, an annular wall, and a surrounding wall. A mounting groove extends inwardly from a top surface of the central portion. A bottom of the mounting groove is disposed with a water outflow passage. The mounting groove is disposed with a functional member. An opening of the first mounting groove is connected to one of the two water dividing passages. An annular chamber defined between the surrounding wall and the central portion is connected to another of the two water dividing passages to generate aerated water.

11 Claims, 6 Drawing Sheets

(58) Field of Classification Search
USPC .... 239/391, 392, 394, 428.5, 442, 444, 445, 239/446, 448, 449
See application file for complete search history.

(56) References Cited

U.S. PATENT DOCUMENTS

| | | | | |
|---|---|---|---|---|
| 7,677,473 | B2 | 3/2010 | Kao | |
| 9,550,195 | B1 * | 1/2017 | Cao | B05B 1/1609 |
| 2012/0085955 | A1 * | 4/2012 | Kim | F16K 11/074 251/286 |
| 2014/0300010 | A1 * | 10/2014 | Zhou | E03C 1/084 261/78.2 |
| 2019/0376265 | A1 * | 12/2019 | Huang | B05B 1/169 |
| 2021/0148100 | A1 * | 5/2021 | Zhou | E03C 1/0405 |

FOREIGN PATENT DOCUMENTS

| | | | |
|---|---|---|---|
| CN | 105937255 | A | 9/2016 |
| CN | 106015642 | A | 10/2016 |
| CN | 106703132 | A | 5/2017 |
| CN | 207063051 | U | 3/2018 |
| DE | 102015003246 | A1 | 9/2016 |

* cited by examiner

MULTIFUNCTIONAL WATER OUTFLOW DEVICE AND WATER FLOW DIVIDER

RELATED APPLICATIONS

This application is a continuation of and claims priority to PCT Patent Application PCT/CN2018/089592, filed on Jun. 1, 2018, which claims priority to Chinese Patent Application 201710494497.0 and Chinese Patent Application 201720750840.9, both filed on Jun. 26, 2017. PCT Patent Application PCT/CN2018/089592, Chinese Patent Application 201710494497.0, and Chinese Patent Application 201720750840.9 are incorporated herein by reference.

FIELD OF THE DISCLOSURE

The present disclosure relates to a multifunctional water outflow device and a water flow divider, in particular to a multifunctional water outflow device and a water flow divider capable of generating aerated water.

BACKGROUND OF THE DISCLOSURE

There are multifunctional water outflow devices, such a jet regulator as disclosed in CN105937255A, which comprises a jet regulator housing including at least two housing parts which are rotatable relative to one another. An inflow-side of the at least two housing parts is mountable in a rotationally fixed manner on a water outflow of a sanitary outflow fitting, and at least at an outflow-side housing outer circumference of an outflow-side of the at least two housing parts is configured as a handle or is connected to a handle. The first housing part has a jet splitter having a plurality of splitter openings, and mutually spaced-apart jet ducts are provided on a housing inner circumference of the second housing part. Individual jets coming from the splitter openings are adapted to be guided through the jet ducts and are adapted to be formed into an annularly circumferential outflow jet pattern when the housing parts are in a first rotary position. The individual jets coming from the splitter openings are adapted to be deflected in a housing interior of the jet regulator toward a central outflow opening in the jet regulator housing when the housing parts are in a second rotary position. A rotary latch having at least one latching tooth is provided between the first housing part and the second housing part. The latching tooth is integrally formed on a duct wall and faces the housing interior of the jet regulator housing. At least one of the jet ducts and the latching tooth interact with a latching profile, which is arranged on a circumferential wall of the first housing part. A mesh structure extends over the central outflow opening. The aforementioned jet regulator has the following disadvantages: the jet ducts, which are separated from each other, open into the inner circumference of the second housing part, resulting in a complicated structure and high manufacturing cost.

Another example is a bubbler structure with functional member, as disclosed in CN106015642A, which comprises a body and a bubble generator disposed in the body. The body is provided with a hollow isolation column, and the hollow isolation column is provided with inner core for realizing different water sprays. A water inflow end of the body is disposed at a water outflow end of a single button regulating valve, and the single button regulating valve comprises a valve body having a water inflow end, a water outflow end, and a water passage provided in the valve body. The water passage is provided with a button and a valve core driven by the button. When the valve body is in a first working position, the water inflow end of the valve body is connected to a periphery of the hollow isolation column. When the valve body is in a second working position, the water inflow end of the valve body is connected to an inner hole of the hollow isolation column. The aforementioned bubbler structure has the following disadvantages: a single button regulating valve needs to be additionally provided, and the structure is complicated.

BRIEF SUMMARY OF THE DISCLOSURE

The present disclosure provides a multifunctional water outflow device and a water flow divider to solve deficiencies of complicated structures of the existing techniques.

In order to solve the aforementioned technical problems, a first technical solution of the present disclosure is as follows.

A multifunctional water outflow device, comprises a connecting portion, and a water outflow portion configured to rotate relative to the connecting portion. The connecting portion is disposed with a water inflow passage. The water outflow portion comprises a lower casing, and a water dividing portion and a water flow divider are disposed in the lower casing. The water dividing portion is disposed with two water dividing passages. The two water dividing passages are respectively switched to connect to the water inflow passage by rotating the water outflow portion relative to the connecting portion. The water flow divider comprises a central portion, an annular wall surrounding the central portion, and a surrounding wall extending upward from an external periphery of the annular wall. The surrounding wall is disposed with at least one dividing hole, and a first mounting groove extends inwardly from a top surface of the central portion. A bottom of the first mounting groove is disposed with a water outflow passage. An inner side of the first mounting groove is disposed with a functional member, and the water flow divider is disposed below the water dividing portion. An opening of the first mounting groove is connected to a first water dividing passage of the two water dividing passages, and an annular chamber defined between the surrounding wall and the central portion is connected to a second water dividing passage of the two water dividing passages to generate aerated water.

In another preferred embodiment, the multifunctional water outflow device further comprises an aerated water casing disposed on a lower port of the lower casing. The aerated water casing is disposed with at least one air suction hole passing through an inner side and an outer side of the aerated water casing. A grid is disposed in the aerated water casing, and water flowing out from the at least one dividing hole impacts the grid. A middle portion of the grid is disposed with a mounting hole passing through an upper side and a lower side of the grid, and a lower end of the central portion is disposed in the mounting hole.

In another preferred embodiment, the multifunctional water outflow device further comprises a mounting ring. An upper peripheral edge of the surrounding wall extends outward to define an outer circumference, and the mounting ring supports the outer circumference. An annular gap is defined between the mounting ring and the surrounding wall. The at least one dividing hole faces the mounting ring, and water injected out from the at least one dividing hole impacts the mounting ring and then flows out from the annular gap.

In another preferred embodiment, the connecting portion comprises a lower connecting seat, and the lower connecting seat is disposed in the lower casing. The lower connecting seat, the water dividing portion, the mounting ring, and the aerated water casing are arranged in sequence in a downward direction, and the aerated water casing is disposed on the lower casing. The water dividing portion and the mounting ring are disposed in the lower casing.

In another preferred embodiment, the connecting portion comprises an upper casing and an upper connecting seat fixedly disposed in the upper casing. The upper connecting seat is fixedly connected to the lower connecting seat, and a bottom of the lower connecting seat is disposed with a water outlet for the water inflow passage.

In another preferred embodiment, the water outlet is disposed with a sealing cup configured to abut a top surface of the water dividing portion, and an elastic body is disposed between the sealing cup and the lower connecting seat.

In another preferred embodiment, a bottom surface of the lower connecting seat is disposed with a convex cylinder. A circular groove extends inwardly from top surface of the water dividing portion, and the convex cylinder is disposed in the circular groove.

In another preferred embodiment, a second mounting groove extends inwardly from a bottom surface of the lower connecting seat, and the second mounting groove is disposed with an elastic body and a positioning pin abutted by the elastic body. Two positioning grooves extend inwardly from a top surface of the water outflow portion, and the positioning pin is disposed in one of the two positioning grooves.

In another preferred embodiment, the water dividing portion comprises a water dividing plate and a rotating cover, and the water dividing plate and the rotating cover are fixedly connected to define the two water dividing passages. The water dividing plate is disposed with at least two water inlet respectively corresponding to the two water dividing passages, and the at least two water inlet is circumferentially disposed along an arc around a rotation axis of the water outflow portion at intervals. A sleeve body is disposed at a center of a bottom portion of the rotating cover. The rotating cover is disposed with at least one water outlet corresponding to the two water dividing passages, and an inner hole of the sleeve body is defined as a first water outlet of the first water dividing passage. A bottom of the rotating cover is disposed with at least two second water outlet of the second water dividing passage circumferentially surrounding the sleeve body at intervals.

In another preferred embodiment, the sleeve body is disposed in the annular chamber between the central portion and the surrounding wall and sealed with an outer wall of the central portion.

In another preferred embodiment, an outer wall of the upper casing and an outer wall of the lower casing are aligned.

A second technical solution of the present disclosure is as follows:

A water flow divider comprises a central portion, an annular wall surrounding an outer side of the central portion, and a surrounding wall extending upward from an external periphery of the annular wall. The surrounding wall is disposed with at least one dividing hole, and a first mounting groove extends inwardly from a top surface of the central portion. A bottom of the first mounting groove is disposed with a water outflow passage, and the first mounting groove is configured to mount a functional member.

Compared with existing techniques, the technical solution of the present disclosure has the following advantages.

The multifunctional water outflow device comprises a connecting portion and a water outflow portion. The two water dividing passages are respectively switched to connect to the water inflow passage by rotating the water outflow portion relative to the connecting portion. That is, the multifunctional water outflow device itself has a switching function, and an additional switching valve is not needed. Therefore, the structure is simple, the cost to manufacture is reduced, and assembly is easier. The present disclosure further comprises a water dividing portion and a water flow divider. The water dividing portion is disposed with at least one water dividing passage, and the at least one water dividing passage does not need to be disposed on a casing. Therefore, a structure of the casing is simple and the cost to manufacture is reduced. The water flow divider comprises a central portion, an annular wall and a surrounding wall. The surrounding wall is disposed with at least one dividing hole. A top surface of the central portion is disposed with a first mounting groove, and a bottom of the first mounting groove is disposed with a water outflow passage. An inner side of the first mounting groove is disposed with a functional member. All of the water flows out from the water flow divider. Therefore the structure is simple and a sealing arrangement of the water outflow device is convenient. Moreover, aerated water is disposed at an outer side, and spray water is disposed at an inner side. Therefore, assembly of the functional member is convenient, an air suction of the aerated water is facilitated, the structure is simple, the arrangement is reasonable to manufacture, and the structure is compact.

The aerated water casing is disposed on the lower port of the lower casing, and the aerated water casing is disposed with the at least one air suction hole passing through the inner side and the outer side of the aerated water casing. The grid is disposed in the aerated water casing, and water flowing out from the at least one dividing hole impacts on the grid. The middle portion of the grid is provided with the mounting hole passing through the upper side and the lower side of the grid, and the lower end of the central portion is disposed in the mounting hole. The structure is simple, and the connection is secure and reliable.

The mounting ring is configured to connect to the water flow divider, the aerated water casing and the lower casing, and is also configured to collide with and refine the water flow.

The connecting portion comprises the lower connecting seat, and the lower connecting seat is disposed in the lower casing. The lower connecting seat, the water dividing portion, the mounting ring, and the aerated water casing are arranged in sequence in a downward direction. The aerated water casing is disposed on the lower casing, and the water dividing portion and the mounting ring are disposed in the lower casing. This arrangement is configured to guide a rotation of the lower casing. Moreover, the lower casing, the lower connecting seat, the water dividing portion, the mounting ring and the aerated water casing are connected. The structure is compact and the arrangement is reasonable to manufacture.

The connecting portion comprises the upper casing, and the upper connecting seat fixedly disposed in the upper casing. The upper connecting seat is fixedly connected to the lower connecting seat, and the bottom of the lower connecting seat is disposed with the water outlet for the water inflow passage. Assembly is convenient and the connection is secure and reliable.

The water outlet is disposed with the sealing cup configured to abut the top surface of the water dividing portion, and the elastic body is disposed between the sealing cup and the lower connecting seat. A sealing performance is enhanced and a hand feeling for switching is improved.

The bottom surface of the lower connecting seat is disposed with the convex cylinder. The circular groove extends inwardly from the top surface of the water dividing portion, and the convex cylinder is disposed in the circular groove. Therefore, an axial abutment is achieved and an axial positioning is also achieved.

The sleeve body is disposed in the annular chamber between the central portion and the surrounding wall and sealed with an outer wall of the central portion. Therefore, one of the two water dividing passages can be connected, and a positioning and locking of each component can be achieved.

The outer wall of the upper casing and the outer wall of the lower casing are aligned, the appearance is beautiful, and assembly is convenient.

BRIEF DESCRIPTION OF THE DRAWING

The present disclosure will be further described below with the combination of the accompanying drawings together with the embodiments.

DETAILED DESCRIPTION OF THE EMBODIMENTS

Embodiment 1

Figure 6:
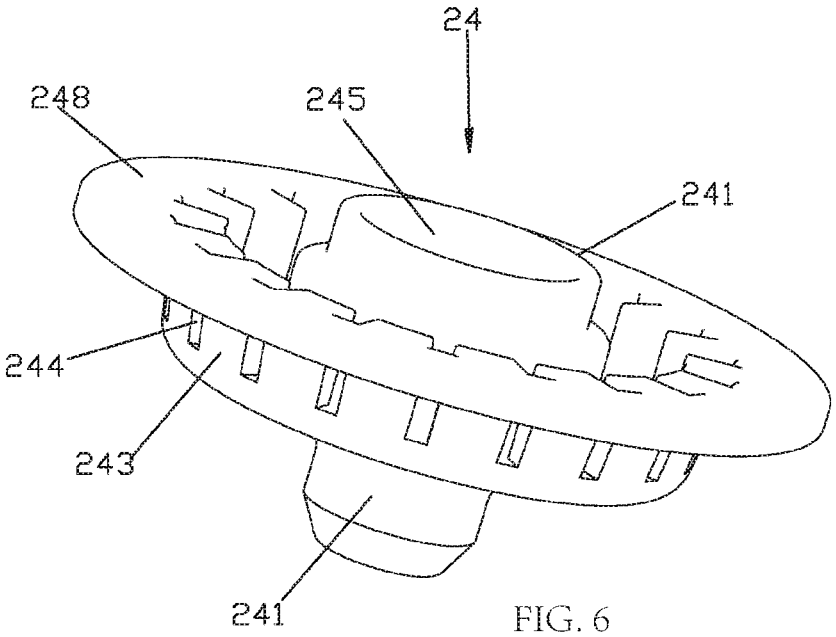
FIG. 6 illustrates a perspective schematic view of a water flow divider of Embodiment 1 of the present disclosure.
Figure 7:
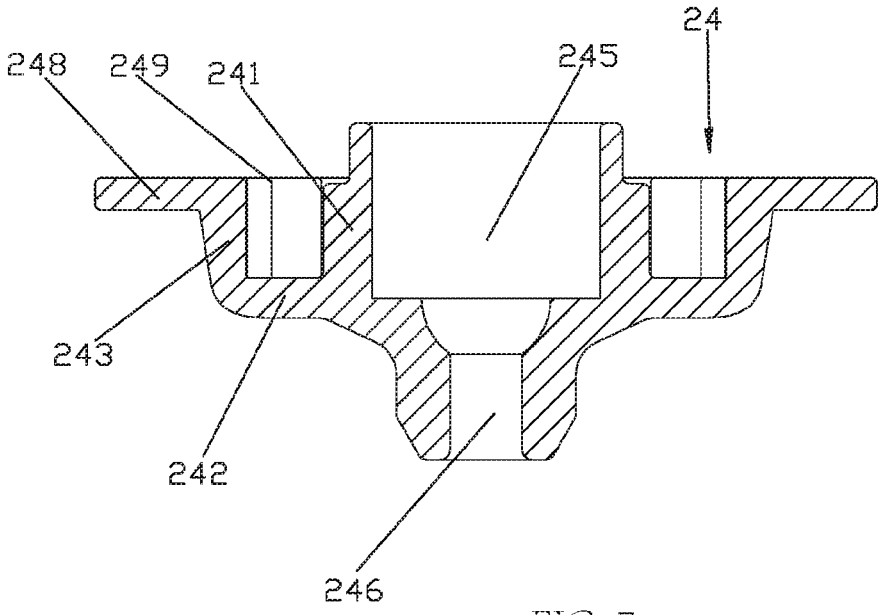
FIG. 7 illustrates a cross-sectional view of the water flow divider of Embodiment 1 of the present disclosure.

Referring to FIGS. 6 and 7, a water flow divider 24 comprises a central portion 241, an annular wall 242 surrounding the central portion 241, and a surrounding wall 243 extending upward from an external periphery of the annular wall 242. The surrounding wall 243 is disposed with at least one dividing hole 244, and a first mounting groove 245 extends inwardly from a top surface of the central portion 241. A bottom of the first mounting groove 245 is disposed with a water outflow passage 246, and the first mounting groove 245 is configured to mount with a functional member. An upper peripheral edge of the surrounding wall 243 is further disposed with an outer circumference 248 extending horizontally and outwardly.

The first mounting groove 245 is connected to the water outflow passage 246 to define a central water outflow passage. An annular chamber 249 is defined between the surrounding wall 243 and the central portion 241, and the annular chamber 249 is connected to the at least one dividing hole 244 to define an annular outer outflow passage.

Embodiment 2

Referring to FIGS. 1-5, a multifunctional water outflow device comprises a connecting portion 1 and a water outflow portion 2 configured to rotate relative to the connecting portion 1. The connecting portion 1 is disposed with a water inflow passage 11. The water outflow portion 2 is disposed with two water dividing passages 21, and the two water dividing passages 21 are respectively switched to connect to the water inflow passage 11 by rotating the water outflow portion 2 relative to the connecting portion 1. The water outflow portion 2 comprises a lower casing 22, and a water dividing portion 23 and a water flow divider 24 are disposed in the lower casing 22. The water dividing portion 23 is disposed with the two water dividing passages 21.

Referring to FIGS. 1-7, the water flow divider 24 comprises a central portion 241, an annular wall 242 surrounding the central portion 241, and a surrounding wall 243 extending upward from an external periphery of the annular wall 242. The surrounding wall 243 is disposed with at least one dividing hole 244, and a top surface of the central portion 241 is disposed with a first mounting groove 245. A bottom of the first mounting groove 245 is disposed with a water outflow passage 246, and an inner side of the first mounting groove 245 is disposed with a functional member 247. The water flow divider 24 is disposed below the water dividing portion 23. An opening of the first mounting groove 245 is connected to a first water dividing passage of the two water dividing passages 21, and an annular chamber 249 defined between the surrounding wall 243 and the central portion 241 is connected to a second water dividing passage of the two water dividing passages 21 to generate aerated water.

Referring to FIGS. 1-7, in a detailed structure of this embodiment:

The water outflow portion 2 further comprises an aerated water casing 25 disposed on a lower port of the lower casing 22. In this embodiment, the aerated water casing 25 is disposed with a sleeve member, and an outer side of the sleeve member is disposed with an external thread. The external thread is screwed to an internal thread of the lower port of the lower casing 22. The aerated water casing 25 is disposed with at least one air suction hole 251 passing through an inner side and an outer side of the aerated water casing 25, and a grid 252 is disposed in the aerated water casing 25. Water flowing out from the at least one dividing hole 244 impacts the grid 252. A middle portion of the grid 252 is disposed with a mounting hole 253 passing through an upper side and a lower side of the grid 252. A lower end of the central portion 241 is disposed in the mounting hole 253.

The water outflow portion 2 further comprises a mounting ring 26. An upper peripheral edge of the surrounding wall 243 extends outward to define an outer circumference 248, and the mounting ring 26 supports the outer circumference 248. An annular gap 50 is defined between the mounting ring 26 and the surrounding wall 243, and the at least one dividing hole 244 faces the mounting ring 26. Water injected out from the at least one dividing hole 244 impacts the mounting ring 26 and then flows out from the annular gap 50. An external periphery of a lower portion of the mounting ring 26 protrudes to define a lock ring 261, and a lock slot extends inwardly from an inner wall of the sleeve member of the aerated water casing 25. The lock ring 261 is inserted into the lock slot to connect the mounting ring 26 and the aerated water casing 25 together.

The connecting portion 1 comprises a lower connecting seat 12, and the lower connecting seat 12 is disposed in the lower casing 22. The lower connecting seat 12, the water dividing portion 23, the mounting ring 26 and the aerated water casing 25 are arranged in sequence in a downward direction, and when the aerated water casing 25 is disposed on the lower casing 22, the water dividing portion 23 and the mounting ring 26 are disposed in the lower casing 22. Furthermore, a bottom surface of the lower connecting seat 12 is disposed with a convex cylinder 121, and a circular groove 233 extends inwardly from a top surface of a water dividing plate 231 of the water dividing portion 23. The convex cylinder 121 is inserted into the circular groove 233 for axial alignment. The water dividing portion 23 comprises the water dividing plate 231 and a rotating cover 232. The water dividing plate 231 and the rotating cover 232 are relatively fixedly disposed, and the two water dividing passages 21 are defined between the water dividing plate 231 and the rotating cover 232. The water dividing plate 231 is disposed with at least two water inlet respectively corresponding to the two water dividing passages 21, and the at least two water inlet is circumferentially disposed along an arc around a rotation axis of the water outflow portion 2 at intervals. A sleeve body 234 is disposed at a center of a bottom portion of the rotating cover 232, and the rotating cover 232 is disposed with at least one water outlet respectively corresponding to the two water dividing passages 21. An inner hole of the sleeve body 234 is disposed a first water outlet corresponding to the first water dividing passage, and a bottom of the rotating cover 232 is disposed with at least two second water outlet of the second water dividing passage circumferentially surrounding the sleeve body 234 at intervals. The sleeve body 234 is inserted into the annular chamber 249 between the central portion 241 and the surrounding wall 243 and sealed with an outer wall of the central portion 241. For example, a sealing ring is used for sealing. Therefore, the sleeve body 234 of the first water dividing passage is connected to a first mounting groove 245 of the central portion 241, and the second water dividing passage surrounding the sleeve body 234 is connected to the annular chamber 249 between the central portion 241 and the surrounding wall 243. The aforementioned structure is simple, assembly is convenient, and the product is convenient for machining and deforming.

A second mounting groove extends inwardly from the bottom surface of the lower connecting seat 12, and the second mounting groove is disposed with an elastic body 122 and a positioning pin 123 abutting the elastic body 122. Two positioning grooves extend inwardly from a top surface of the water dividing plate 231, and the positioning pin is disposed in one of the two positioning grooves. In this way, a switching of the multifunctional water outflow device is maintained in a switching state and a switching feel is improved.

A first sealing portion, such as a sealing ring, is disposed between the rotating cover 232, the mounting ring 26 and the aerated water casing 25. The sealing ring is used for sealing and has elasticity, which can provide a mounting space for assembling, and assembly is convenient.

A rectifier 27 surrounding the sleeve body 234 is disposed above the water flow divider 24, and the rectifier 27 and the sleeve body 234 are annularly disposed at intervals, so that a flow direction of the water is rectified.

The connecting portion 1 comprises an upper casing 13 and an upper connecting seat 14 fixedly disposed in the upper casing 13. The upper connecting seat 14 and the lower connecting seat 12 are fixedly connected by screws. A bottom of the lower connecting seat 12 is disposed with a water outlet for the water inflow passage 11. The water from a water source flows into the upper connecting seat 14, the lower connecting seat 12, and flows out from the water outlet of the water inflow passage 11. The water outlet is disposed with a sealing cup 15 configured to abut the top surface of the water dividing plate 231 of the water dividing portion 23, and an elastic body 16 is disposed between the sealing cup 15 and the lower connecting seat 12. A water flow restrictor 17 and a second sealing portion 18 are further disposed on the upper connecting seat 14.

An outer wall of the upper casing 13 is aligned with an outer wall of the lower casing 22. An upper periphery of the lower casing 22 extends inward to define a lower ring protrusion 221, and an upper periphery of the lower connecting seat 12 extends inward to define an upper ring protrusion 124. The upper connecting seat 14 supports on the upper ring protrusion 124, and the lower connecting seat 12 supports under the lower ring protrusion 221.

Figure 1:
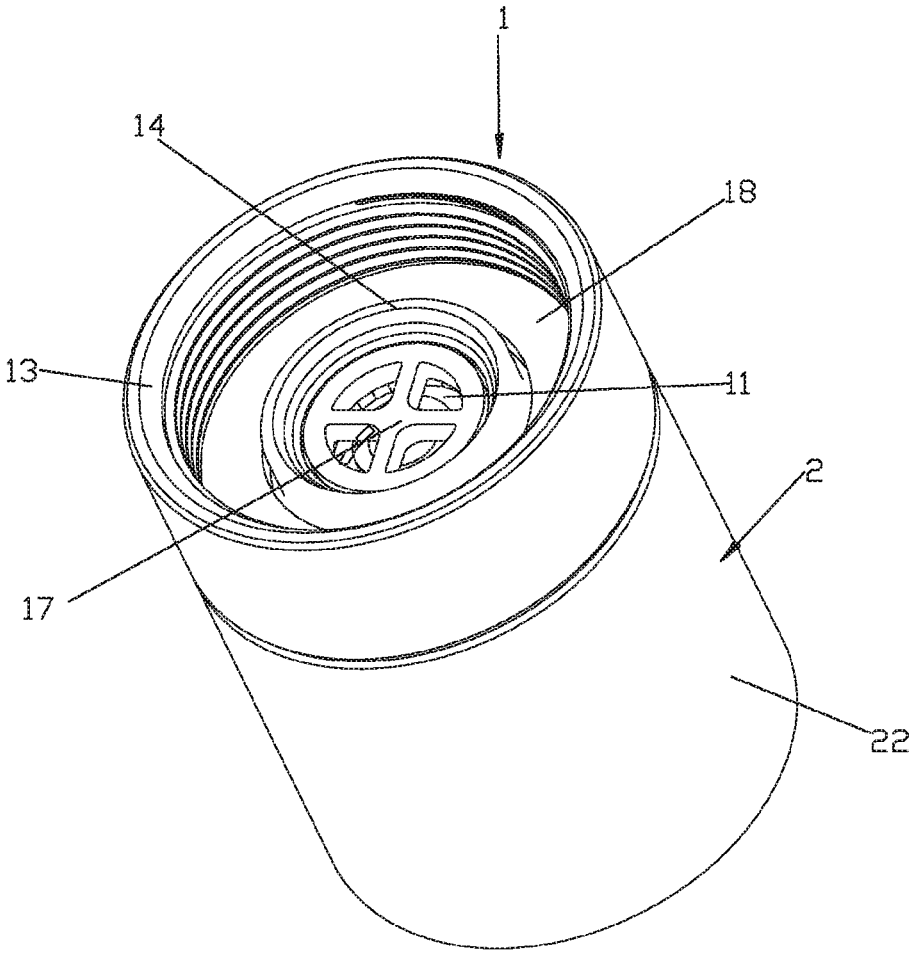
FIG. 1 illustrates a perspective schematic view of a multifunctional water outflow device of Embodiment 2 of the present disclosure.
Figure 2:
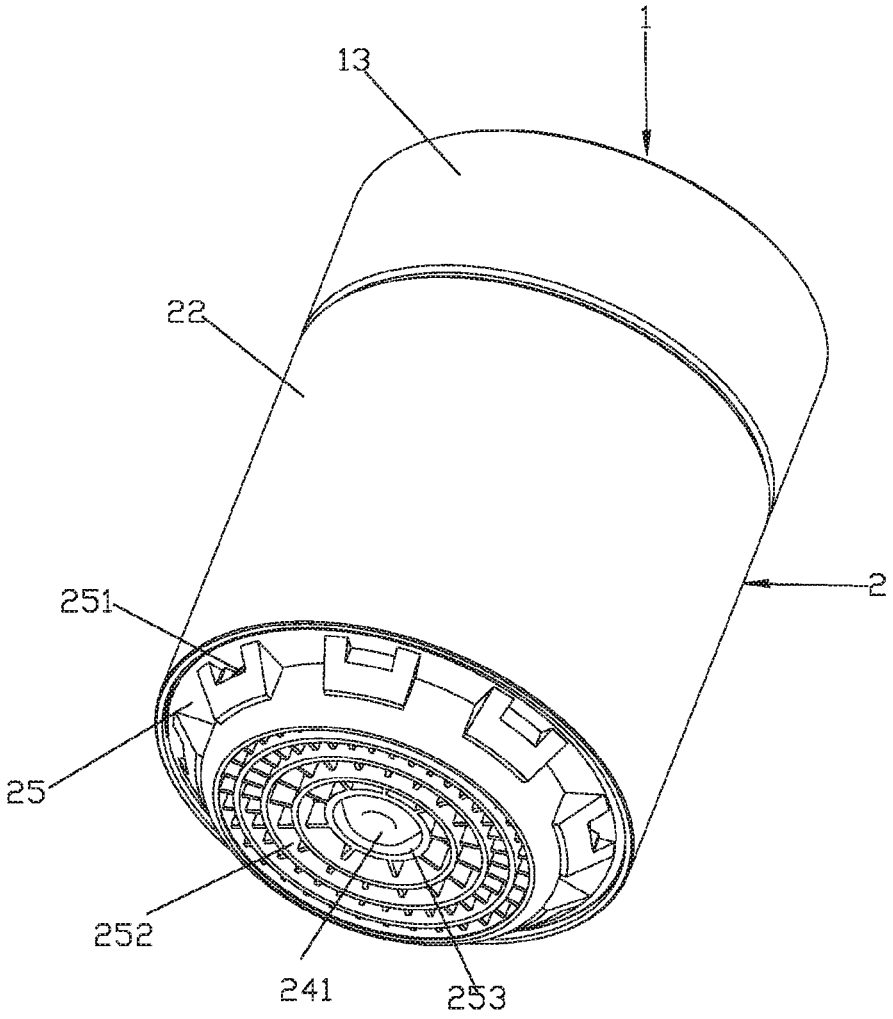
FIG. 2 illustrates a perspective schematic view of the multifunctional water outflow device of Embodiment 2 of the present disclosure.
Figure 3:
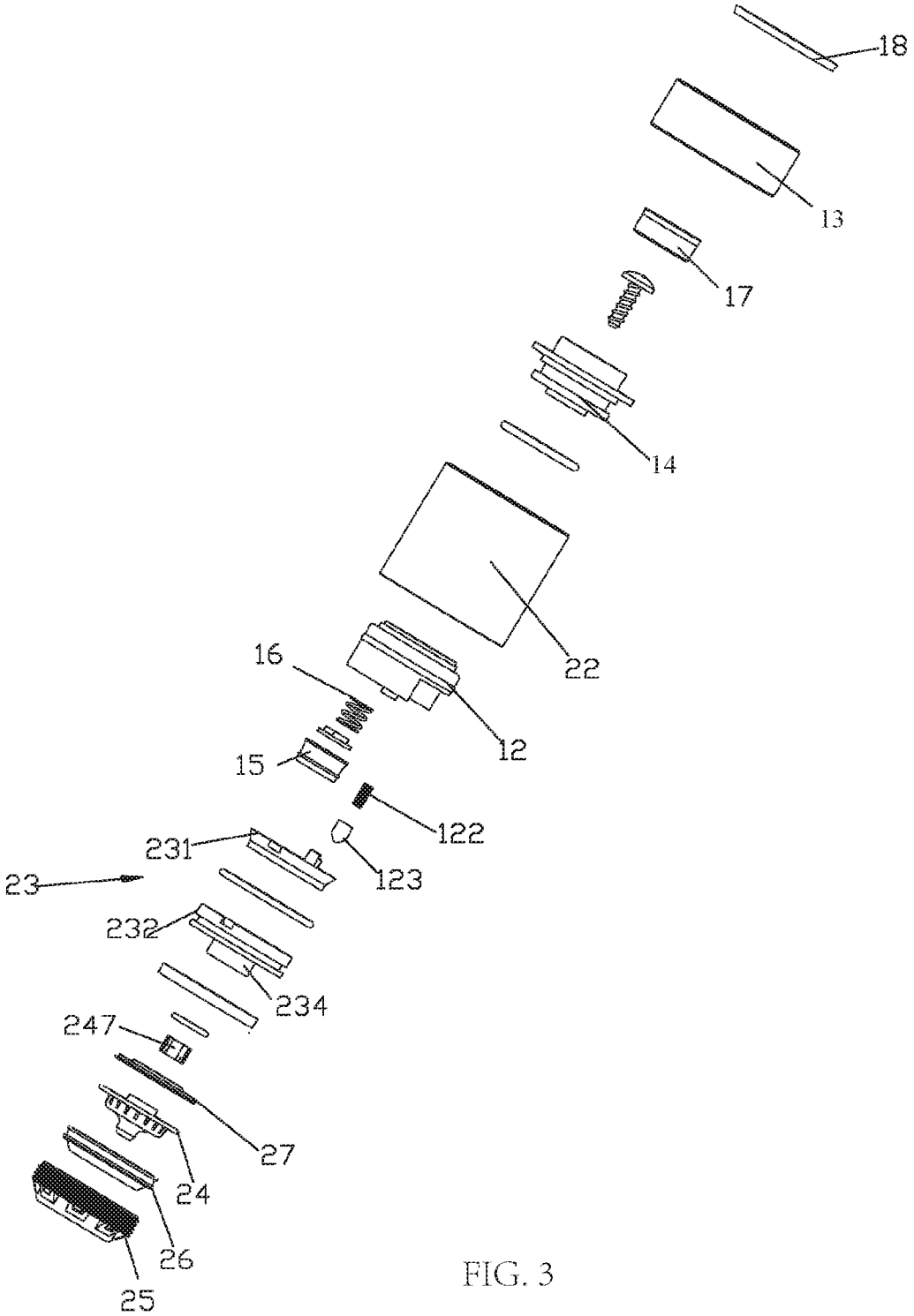
FIG. 3 illustrates an exploded perspective schematic view of the multifunctional water outflow device of Embodiment 2 of the present disclosure.
Figure 4:
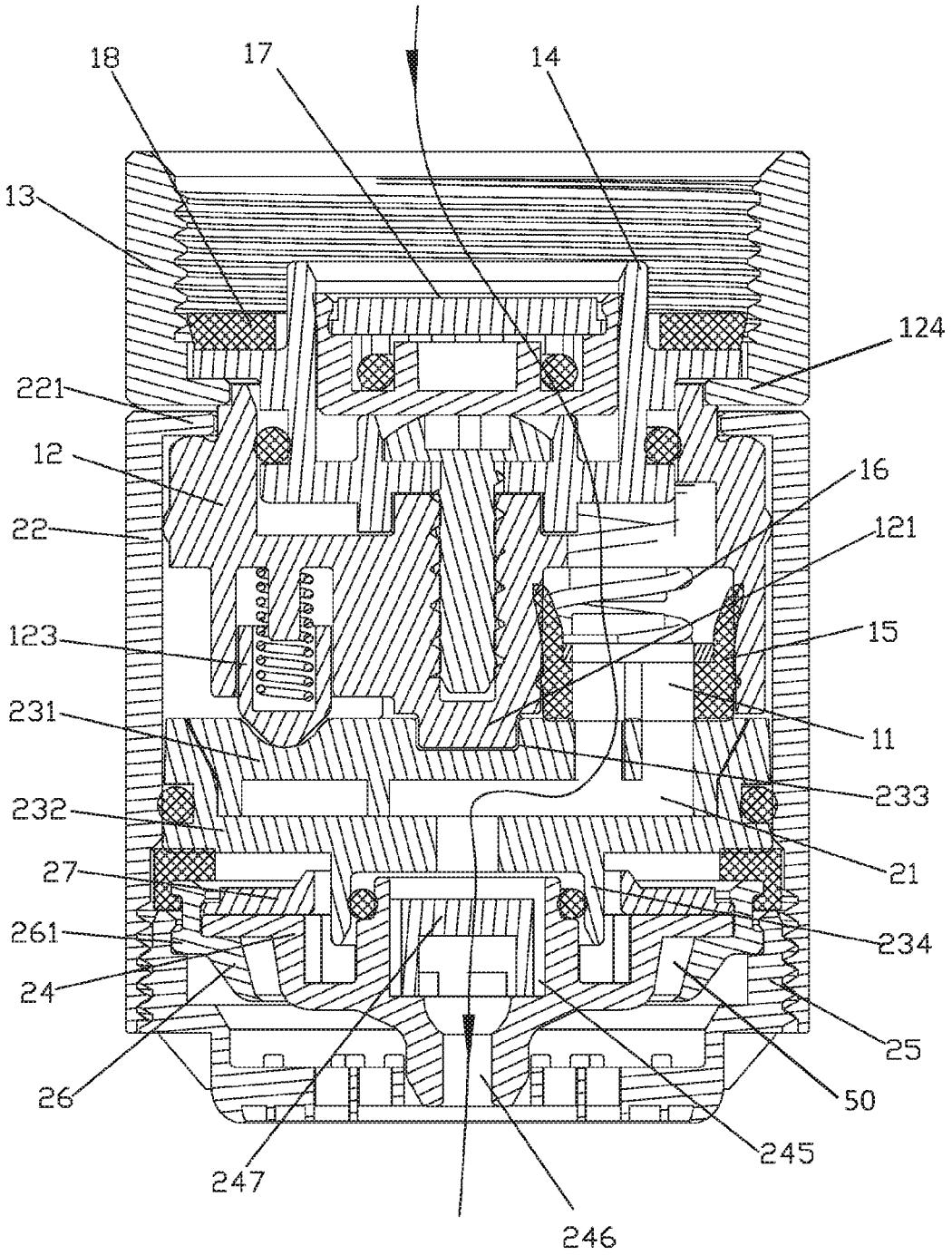
FIG. 4 illustrates a cross-sectional view of the multifunctional water outflow device of Embodiment 2 of the present disclosure, when spray water flows out from the multifunctional water outflow device.
Figure 5:
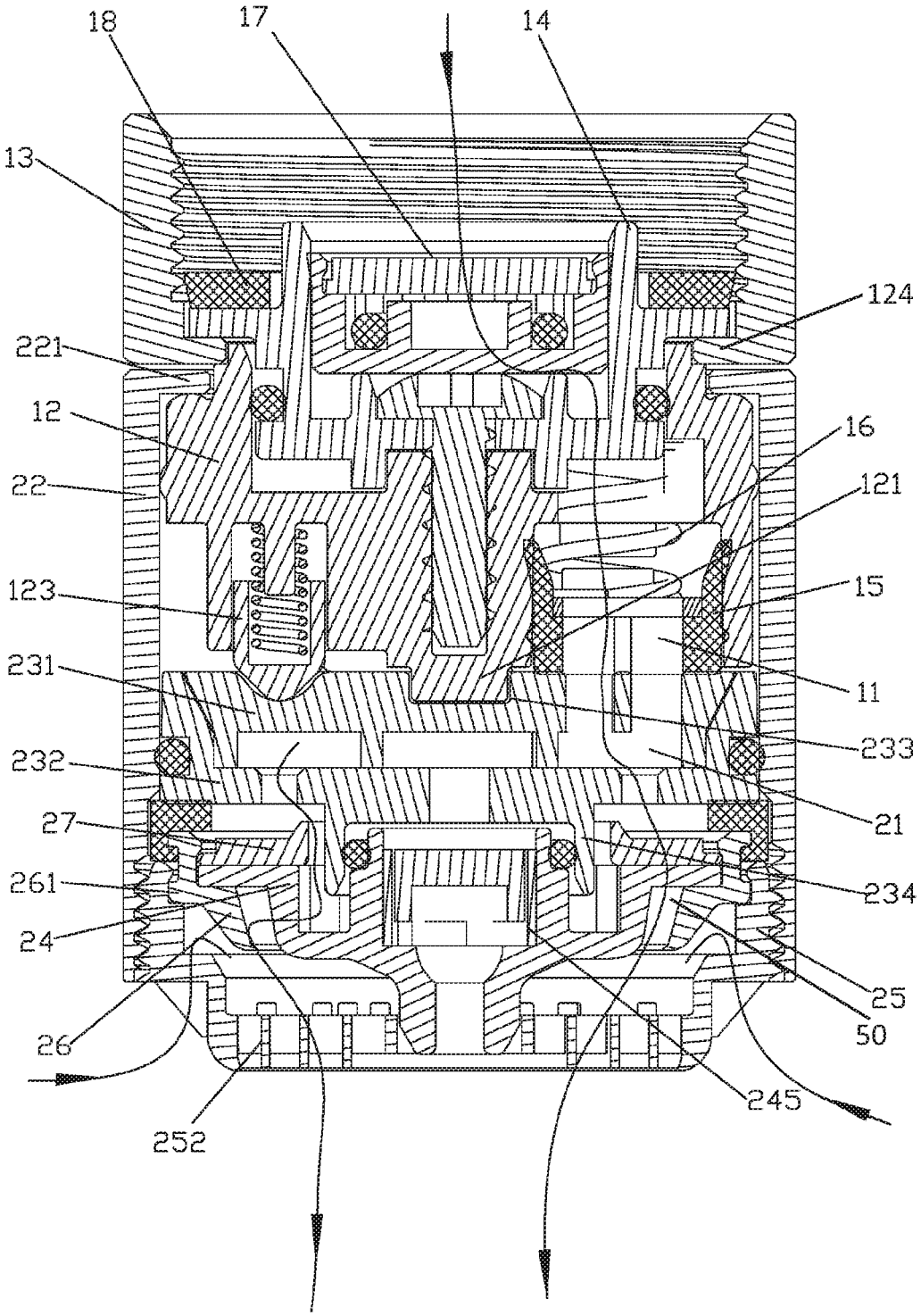
FIG. 5 illustrates a cross-sectional view of the multifunctional water outflow device of Embodiment 2 of the present disclosure, when aerated water flows out from the multifunctional water outflow device.

The water of the water source flows into the upper connecting seat 14, the lower connecting seat 12, flows out from the water outlet of the water inflow passage 11, flows into a water inlet of the first water dividing passage 21, flows into the first mounting groove 245 from the sleeve body 234 of the rotating cover 232 of the water dividing portion 23, and cooperates with the functional member 247 to adjust a water spray pattern. For example, with respect to spray water in FIG. 4, the spray water flows out from a water outflow passage 246. When the water outflow portion 2 is rotated, a water inlet of the second water dividing passage 21 corresponds to the water outlet of the water inflow passage 11. Water flows out from the water outlet of the second water dividing passage surrounding the sleeve body 234 of the rotating cover 232 of the water dividing portion 23, flows through rectifier 27 to the annular chamber 249 between the central portion 241 and the surrounding wall 243 of the water flow divider 24, and then flows out from the at least one water dividing hole 244. Then the water is injected out and mixed with air to obtain aerated water. The aerated water is rectified by the grid 252 and flows out, as shown in FIG. 5.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

INDUSTRIAL APPLICABILITY

The present disclosure discloses a multifunctional water outflow device. The multifunctional water outflow device itself has a switching function and an additional switching valve is not needed. The structure is simple, the cost to manufacture is low, and assembly is convenient. The present disclosure further comprises a water dividing portion and a water flow divider. The water dividing portion is disposed with at least one water dividing passage, and the at least one water dividing passage does not need to be disposed on a casing. Therefore, a structure of the casing is simple, and the cost is reduced. The present disclosure has a wide range of application and a good industrial applicability.

What is claimed is:

1. A multifunctional water outflow device, comprising:
a connecting portion, and
a water outflow portion configured to rotate relative to the connecting portion, wherein:
the connecting portion is disposed with a water inflow passage,
the water outflow portion comprises a lower casing,
a water dividing portion and a water flow divider are disposed in the lower casing,
the water dividing portion is disposed with two water dividing passages,
the two water dividing passages are respectively switched to connect to the water inflow passage by rotating the water outflow portion relative to the connecting portion,
the water flow divider comprises:
a central portion,
an annular wall surrounding the central portion, and
a surrounding wall extending upward from an external periphery of the annular wall,
the surrounding wall is disposed with at least one dividing hole,
a first mounting groove extends inwardly from a top surface of the central portion,
a bottom of the first mounting groove is disposed with a water outflow passage,
an inner side of the first mounting groove is disposed with a functional member,
the water flow divider is disposed below the water dividing portion,
an opening of the first mounting groove is connected to a first water dividing passage of the two water dividing passages, and
an annular chamber defined between the surrounding wall and the central portion is connected to a second water dividing passage of the two water dividing passages to generate aerated water.

2. The multifunctional water outflow device according to claim 1, comprising:
an aerated water casing disposed on a lower port of the lower casing, wherein:
the aerated water casing is disposed with at least one air suction hole passing through an inner side and an outer side of the aerated water casing,
a grid is disposed in the aerated water casing,
water flowing out from the at least one dividing hole impacts the grid,
a middle portion of the grid is disposed with a mounting hole passing through an upper side and a lower side of the grid, and
a lower end of the central portion is disposed in the mounting hole.

3. The multifunctional water outflow device according to claim 2, comprising:
a mounting ring, wherein:
an upper peripheral edge of the surrounding wall extends outward to define an outer circumference,
the mounting ring supports the outer circumference,
an annular gap is defined between the mounting ring and the surrounding wall,
the at least one dividing hole faces the mounting ring, and
water injected out from the at least one dividing hole impacts the mounting ring and then flows out from the annular gap.

4. The multifunctional water outflow device according to claim 3, wherein:
the connecting portion comprises a lower connecting seat,
the lower connecting seat is disposed in the lower casing,
the lower connecting seat, the water dividing portion, the mounting ring, and the aerated water casing are arranged in sequence in a downward direction,
the aerated water casing is disposed on the lower casing, and
the water dividing portion and the mounting ring are disposed in the lower casing.

5. The multifunctional water outflow device according to claim 4, wherein:
the connecting portion comprises an upper casing and an upper connecting seat fixedly disposed in the upper casing,
the upper connecting seat is fixedly connected to the lower connecting seat, and
a bottom of the lower connecting seat is disposed with a water outlet for the water inflow passage.

6. The multifunctional water outflow device according to claim 5, wherein:
the water outlet is disposed with a sealing cup configured to abut a top surface of the water dividing portion, and
an elastic body is disposed between the sealing cup and the lower connecting seat.

7. The multifunctional water outflow device according to claim 4, wherein:
a bottom surface of the lower connecting seat is disposed with a convex cylinder,
a circular groove extends inwardly from a top surface of the water dividing portion, and
the convex cylinder is disposed in the circular groove.

8. The multifunctional water outflow device according to claim 4, wherein:
a second mounting groove extends inwardly from a bottom surface of the lower connecting seat,
the second mounting groove is disposed with an elastic body and a positioning pin abutted by the elastic body,
two positioning grooves extend inwardly from a top surface of the water outflow portion, and
the positioning pin is disposed in one of the two positioning grooves.

9. The multifunctional water outflow device according to claim 4, wherein:
the water dividing portion comprises a water dividing plate and a rotating cover,
the water dividing plate and the rotating cover are fixedly connected to define the two water dividing passages,
the water dividing plate is disposed with at least two water inlets respectively corresponding to the two water dividing passages,
the at least two water inlets is circumferentially disposed along an arc around a rotation axis of the water outflow portion at intervals,
a sleeve body is disposed at a center of a bottom portion of the rotating cover,
the rotating cover is disposed with at least one water outlet corresponding to the two water dividing passages,
an inner hole of the sleeve body is defined as a first water outlet of the first water dividing passage,
a bottom of the rotating cover is disposed with at least two second water outlets of the second water dividing passage circumferentially surrounding the sleeve body at intervals.

10. The multifunctional water outflow device according to claim 9, wherein the sleeve body is disposed in the annular chamber between the central portion and the surrounding wall and sealed with an outer wall of the central portion.

11. The multifunctional water outflow device according to claim 5, wherein an outer wall of the upper casing and an outer wall of the lower casing are aligned.

* * * * *